US006666206B1

(12) United States Patent
Myrick

(10) Patent No.: US 6,666,206 B1
(45) Date of Patent: Dec. 23, 2003

(54) FIREPLACE INSERT

(76) Inventor: Shelton Gene Myrick, 35 Family La., Pell City, AL (US) 35128

( * ) Notice: Subject to any disclaimer, the term of this patent is extended or adjusted under 35 U.S.C. 154(b) by 0 days.

(21) Appl. No.: 10/150,330

(22) Filed: May 16, 2002

(51) Int. Cl.[7] ..... F24B 1/189; F24B 1/182
(52) U.S. Cl. ..... 126/522; 126/524; 126/506
(58) Field of Search ..... 126/506, 507, 126/521, 522, 524

(56) References Cited

U.S. PATENT DOCUMENTS

| | | | | |
|---|---|---|---|---|
| 2,052,643 A | * | 9/1936 | Modine | 126/508 |
| 2,703,566 A | * | 3/1955 | Fogel | 126/507 |
| 3,001,521 A | | 9/1961 | Reilly | |
| 4,018,208 A | | 4/1977 | Hamilton | |
| 4,114,590 A | * | 9/1978 | Frahm | 126/522 |
| 4,188,939 A | * | 2/1980 | Gamso et al. | 126/521 |
| 4,228,784 A | | 10/1980 | Malafouris | |
| 4,320,740 A | | 3/1982 | Lassy et al. | |
| 5,303,692 A | * | 4/1994 | Shasad | 126/506 |
| 5,983,890 A | * | 11/1999 | Thomas et al. | 126/512 |
| 6,065,467 A | * | 5/2000 | Martin | 126/41 R |

FOREIGN PATENT DOCUMENTS

| | | | |
|---|---|---|---|
| DE | 3341974 | * | 7/1984 |

* cited by examiner

*Primary Examiner*—Alfred Basichas
(74) *Attorney, Agent, or Firm*—Smith, Gambrell & Russell, LLP

(57) ABSTRACT

An improved fireplace insert used in a fireplace to surround a heat source, including an arcuate conduit that is able to substantially surround the heat source on multiple sides. The conduit includes an inhaling end and an exhaling end, and divided into an intake channel, a base channel, and an outtake channel. The intake channel includes a proximal end and a distal end; the base channel includes a first end and a second end; and the outtake channel includes a proximal end and a distal end. The proximal end of the intake channel is connected to the first end of the base channel, and the proximal end of the outtake channel is connected to the second end of the base channel for the conduit to be in a significantly U-shape. A fan is positioned near the distal end of the intake channel and is able to force heated air through the conduit.

14 Claims, 9 Drawing Sheets

FIREPLACE INSERT

The present invention was first described in Disclosure Document No. 507,352. There have been no previously filed applications, nor any co-pending applications, anywhere in the world.

FIELD OF THE INVENTION

The present invention relates generally to a fireplace insert, and more particularly, to an improved fireplace insert for transmitting heat into a surrounding area.

BACKGROUND OF THE INVENTION

Conventional fireplaces or hearths have been used in buildings and homes for hundreds of years. The fireplaces have been designed for multiple purposes, but the two primary purposes are to provide heat in the building and to provide an aesthetic light source. While fireplaces have well served the purpose as an aesthetic light source generating a desirable ambiance, they are often inefficient as a heat source, in that the heat is dispersed into multiple directions.

Although wood-burning fireplaces have aesthetic appeal to consumers, various investigations have shown that conventional fireplaces may actually remove more heat from a house than they produce, such that their heating efficiency is quite low. It has been reported that a typical, vertical-back fireplace with an open front is at best ten percent efficient in converting wood to energy and delivering it into a surrounding room, with the remaining portion of the heat energy being discharged through the chimney. In addition, fireplaces may also pull cold air into the house from small gaps around windows and doors. At the beginning and at the completion of the burning of the fire, these convective heat losses are larger than the radiant heat provided by the fire. The large mass of masonry that makes up most fireplaces are poor thermal insulators and readily conduct room heat to the outdoors in cold weather.

To solve the problems provided by conventional fireplaces, several types of accessories have been designed to moderately improve the heating efficiency of the traditional fireplace. In particular, the conventional fireplace insert is known to be the best device to make a significant difference in heating efficiency. The conventional fireplace insert, also known as a convection wood stove, was developed to provide an even and effective heat that warms the surrounding area. Fireplace inserts are appliances that are typically fueled by wood, pellet, or gas, with the fireplace insert fitting into a conventional open fireplace. Some models extend onto the hearth, while others stay flush with the front of the fireplace.

While fireplace inserts provide better heating efficiency, they nonetheless fail to solve related problems, such as having an aesthetically appealing appearance or ease of installation. Although some inserts include aesthetic features such as decorative tile, cast iron, glass doors, or brass trim and handles, they nonetheless often fail to generate the same pleasing aesthetic appearance as the traditional fireplace. In addition, installing a fireplace insert in a chimney can be quite difficult, and moving an insert to clean the chimney or liner can also be difficult, such that it is often best to hire a professional chimney sweep rather than self clean the apparatus.

What is desired, then, and not found in the prior art, is an improved fireplace insert that is easily installed and used in a conventional fireplace and that is able to provide an improved heating efficiency for the area surrounding the insert.

SUMMARY OF THE INVENTION

An object of the present invention is to provide a fireplace insert for distributing heat into the area surrounding the fireplace insert.

A further object of the present invention is to provide a fireplace insert that is able to draw in cool air and propel warm air into a surrounding area.

A further object of the present invention is to provide a fireplace insert that is able to efficiently heat the area surrounding the fireplace insert while maintaining the aesthetic appearance of the fire.

Yet a further object of the present invention is to provide a fireplace insert that is portable as needed by the user.

An additional object of the present invention is to provide a fireplace insert that provides a placement arm for holding food cooking devices over the fire.

The present invention for an improved fireplace insert may be used in a conventional hearth having a standard opening below a chimney with an andiron positioned in the opening to hold fuel to be burned to generate heat. The preferred embodiment of the fireplace insert is positioned in the opening of the hearth to substantially surround the andiron such that the fireplace insert will be proximate the heat source.

The fireplace insert includes an arcuately-shaped conduit that is able to substantially surround the andiron on multiple sides. The conduit includes an inhaling end and an exhaling end. In addition, the conduit may be preferably divided into three sections: an intake channel or duct, a base channel or duct, and an outtake channel or duct. Moreover, the intake channel includes a proximal end and a distal end; the base channel includes a first end and a second end; and the outtake channel includes a proximal end and a distal end. In the preferred embodiment, the proximal end of the intake channel is substantially perpendicularly connected to the first end of the base channel, and the proximal end of the outtake channel is substantially perpendicularly connected to the second end of the base channel. As a result, the conduit has an arcuate or substantially convex shape, or a significantly U-shape.

The fireplace insert further includes an intake air filter that is mounted to the inhaling end of the conduit and an outtake air filter that is attached to the exhaling end of the conduit. Moreover, a fan is mounted or positioned inside the conduit proximate the intake air filter. The fan is operable to draw air into the inhaling end of the conduit through the intake air filter. Furthermore, the fan will propel the air through the conduit and out through the outtake air filter into the area that is surrounding the fireplace insert. The outtake air filter will thereby prevent undesired debris from passing through the conduit. The fan is a conventional blower fan that has a conventional electrical power source, such as a battery.

The fireplace insert additionally includes a series of front legs that are connected proximate the inhaling end and the exhaling end of the conduit, and a series of rear legs that are preferably connected to the base channel of the conduit. In the favored embodiment, the length of the front legs is shorter than the length of the rear legs so that, when the fireplace insert is positioned on a ground surface, the intake channel and the outtake channel will each have a gradual incline.

The fireplace insert is positioned inside the opening of the conventional hearth. The andiron and fuel are placed proximate the base channel of the conduit between the intake channel and the outtake channel. The fan is then activated such that air is drawn into the intake channel and circulated through the conduit. The fuel is then burned so as to generate a high temperature. In the preferred embodiment, the fuel is conventional firewood, although any other form of combusted fuel, such as coal or gas, or any other heat source, could be incorporated into the present design to create the desired high temperature.

The combusted fuel will then act as the heat source for the surrounding area. The heat generated will be transmitted to the conduit, such that both the conduit and the surrounded air will be warmed from the heat source. Moreover, the stream of air produced by the fan through the conduit will be heated quickly. Consequently, the air that is expelled by the outtake cylinder will be warmed significantly to be transmitted into the desired surrounding area. Moreover, the stream of heated air will be propelled with a desired thrusting force as determined by the fan to warm a greater surrounding area than a sole combusted fuel in a conventional fireplace.

BRIEF DESCRIPTION OF THE DRAWINGS

An improved fireplace insert embodying the features of the present invention is depicted in the accompanying drawing which form a portion of this disclosure and wherein.

DESCRIPTION OF THE PREFERRED EMBODIMENT

Figure 1:
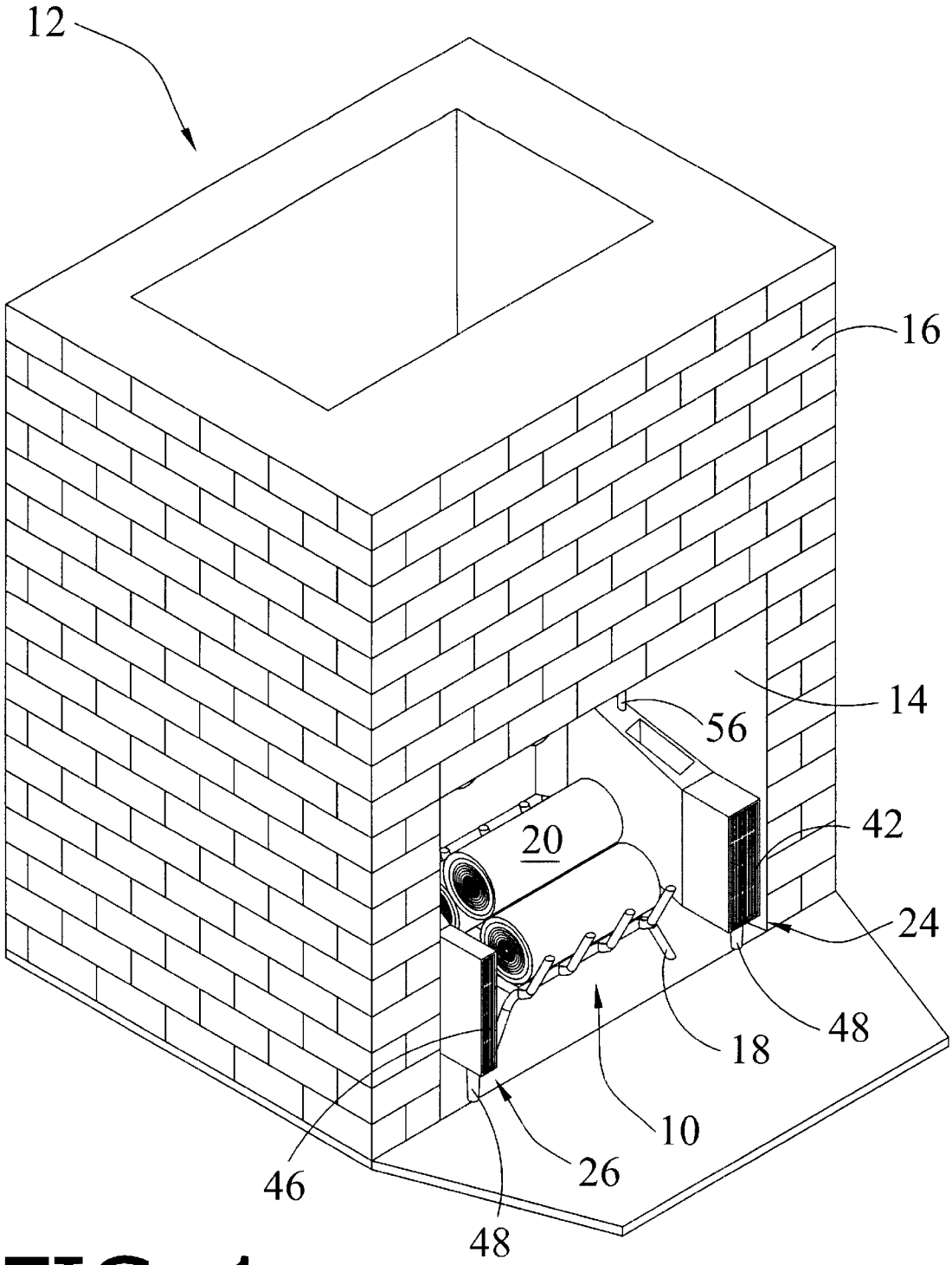
FIG. 1 is a perspective view of the improved fireplace insert of the present invention positioned in a traditional chimney.

Looking now to FIG. 1, the present invention for an improved fireplace insert 10 is illustrated. The fireplace insert 10 may be used in a conventional hearth 12 or fireplace having a standard opening 14 below a chimney 16, with an andiron 18 or grate positioned in the opening to hold fuel 20. The preferred embodiment of the fireplace insert 10 may be positioned in the opening 14 of the hearth 12 to substantially surround the andiron 18 such that when the fuel 20 is combusted to provide a source of heat, the fireplace insert 10 will be heated as well.

Figure 2:
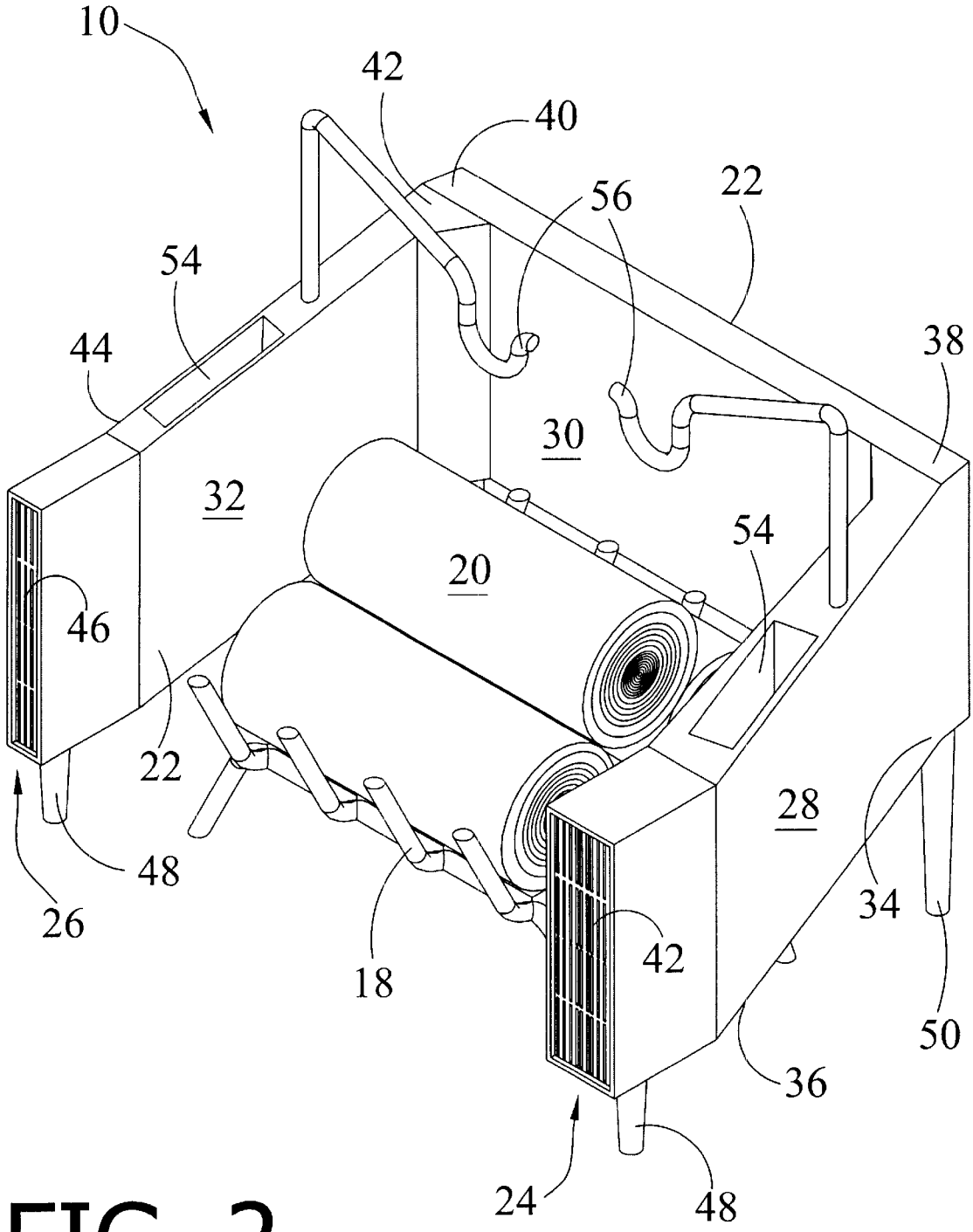
FIG. 2 is a perspective view of the improved fireplace insert of the present invention.
Figure 3:
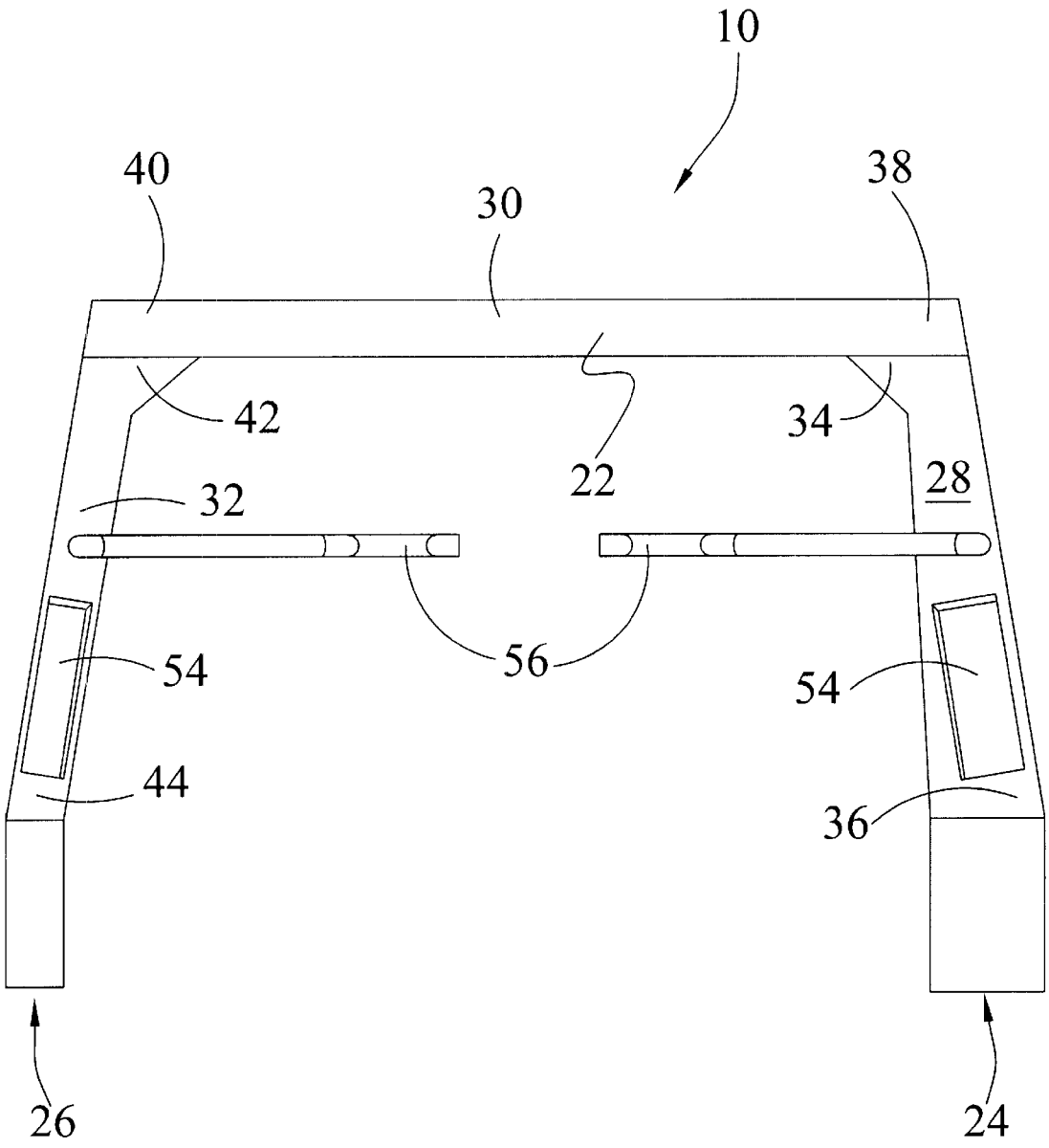
FIG. 3 is a top plan view of the improved fireplace insert of the present invention as illustrated in FIG. 2.
Figure 4:
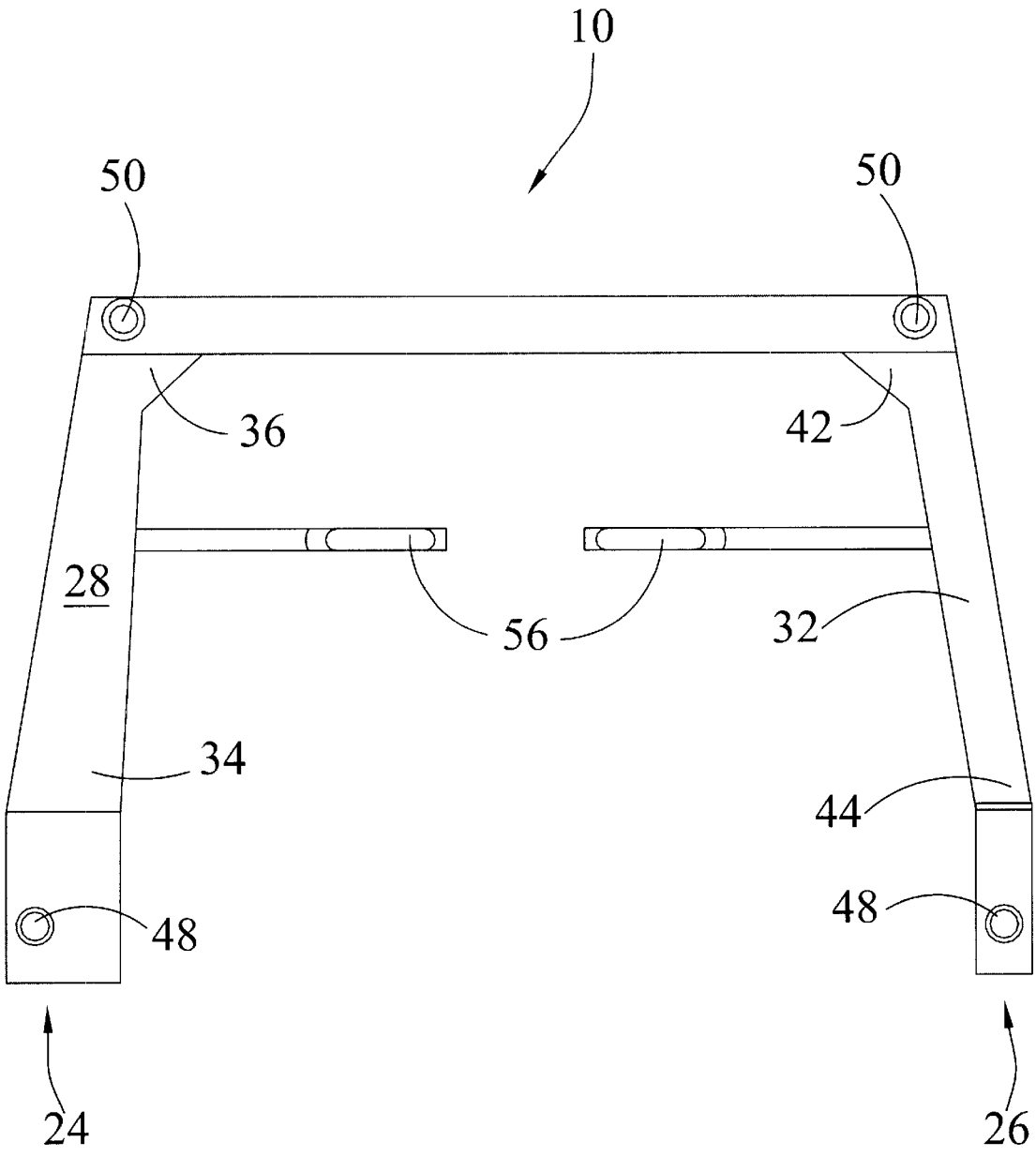
FIG. 4 is a bottom view of the improved fireplace insert of the present invention as illustrated in FIG. 2.
Figure 5:
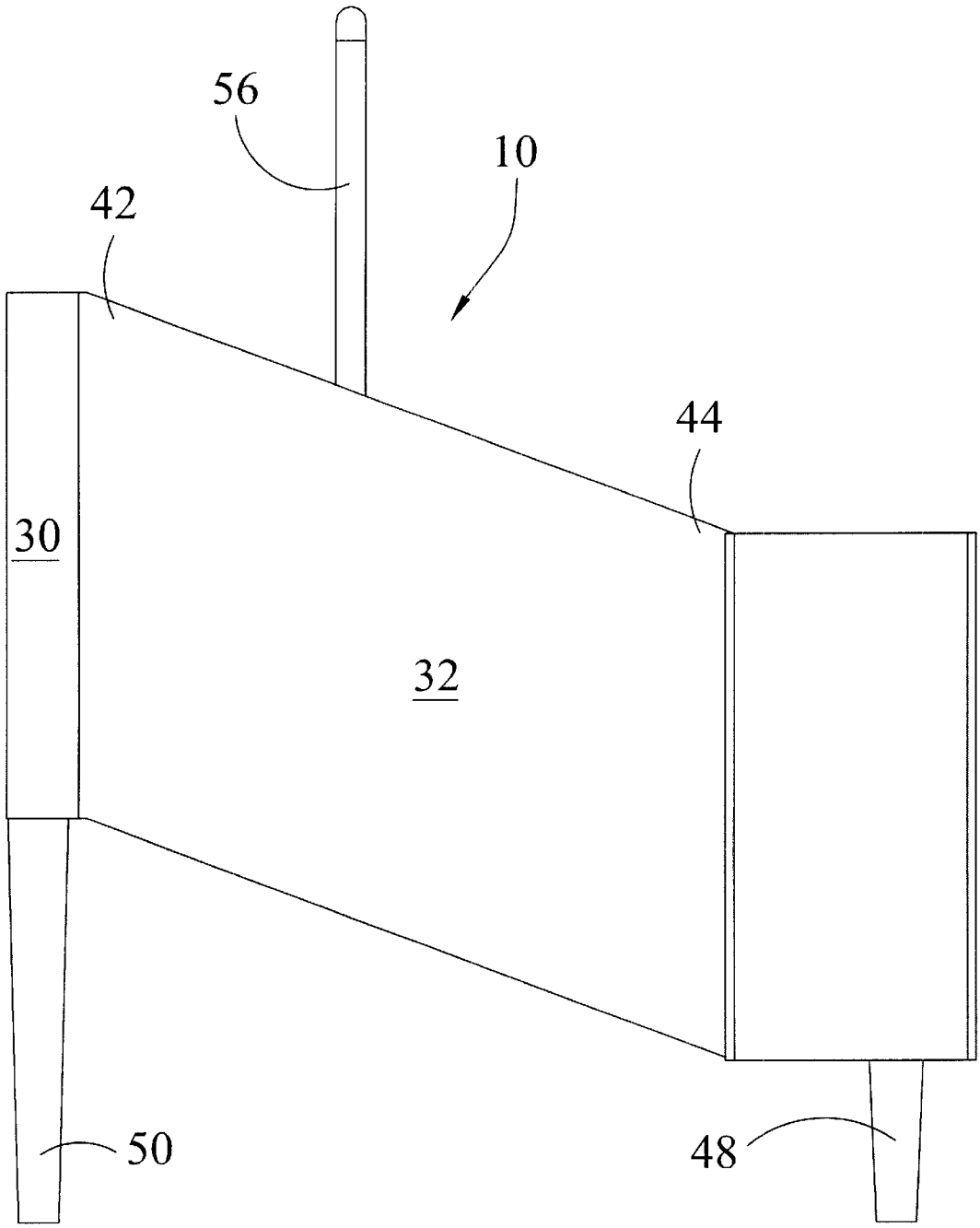
FIG. 5 is a left side elevational view of the improved fireplace insert of the present invention as illustrated in FIG. 2.
Figure 6:
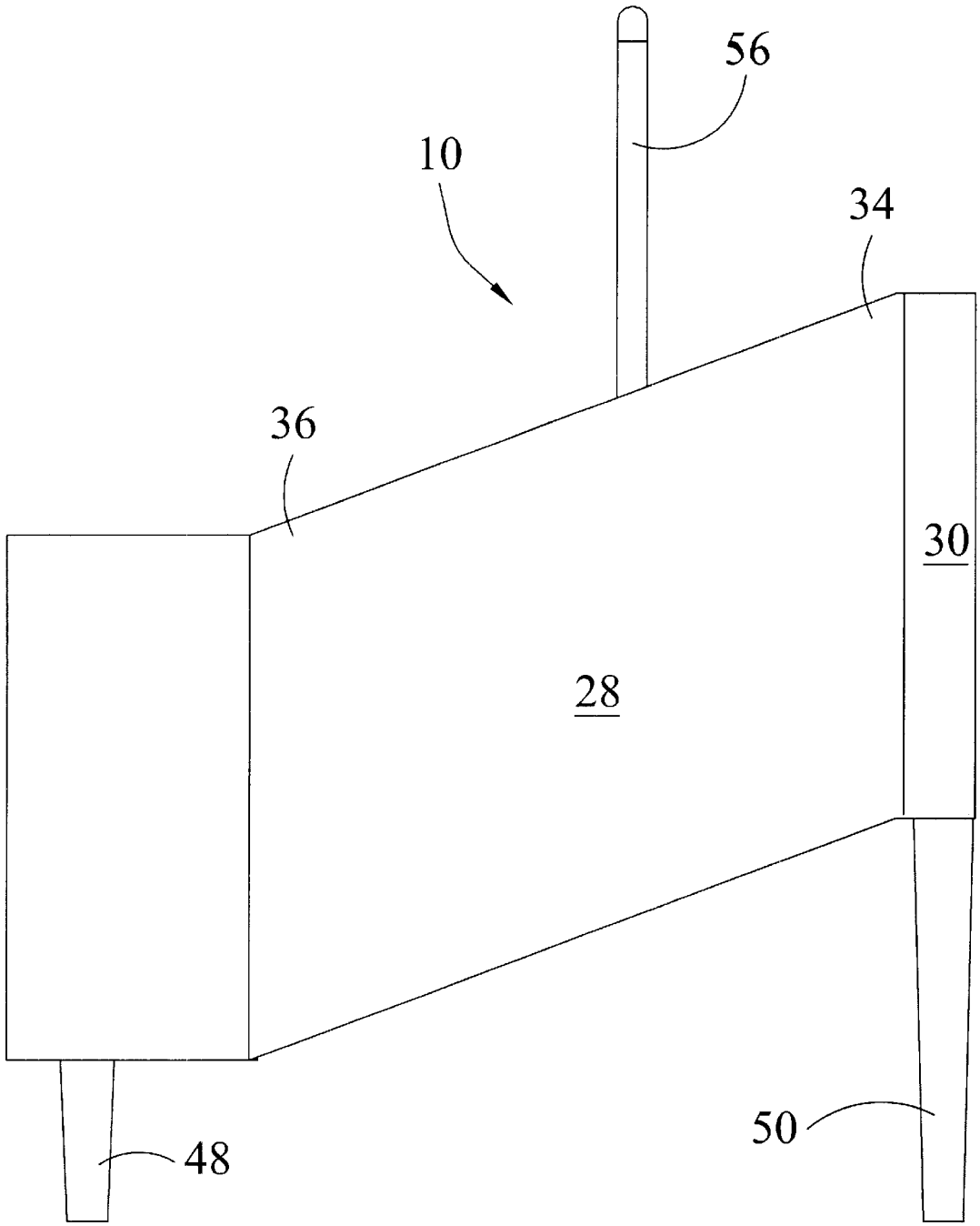
FIG. 6 is a right side elevational view of the improved fireplace insert of the present invention as illustrated in FIG. 2.
Figure 7:
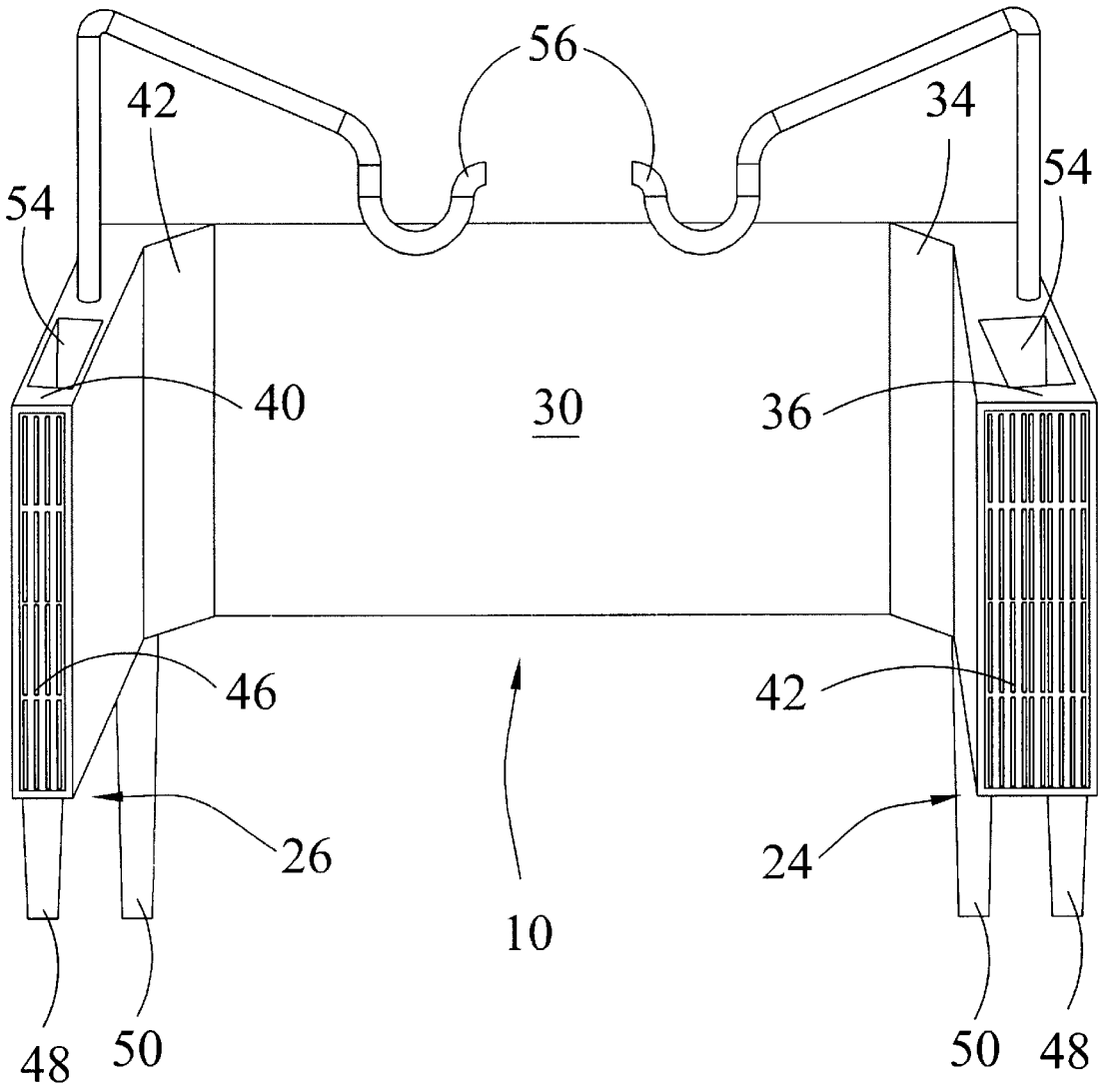
FIG. 7 is a front elevational view of the improved fireplace insert of the present invention as illustrated in FIG. 2.
Figure 8:
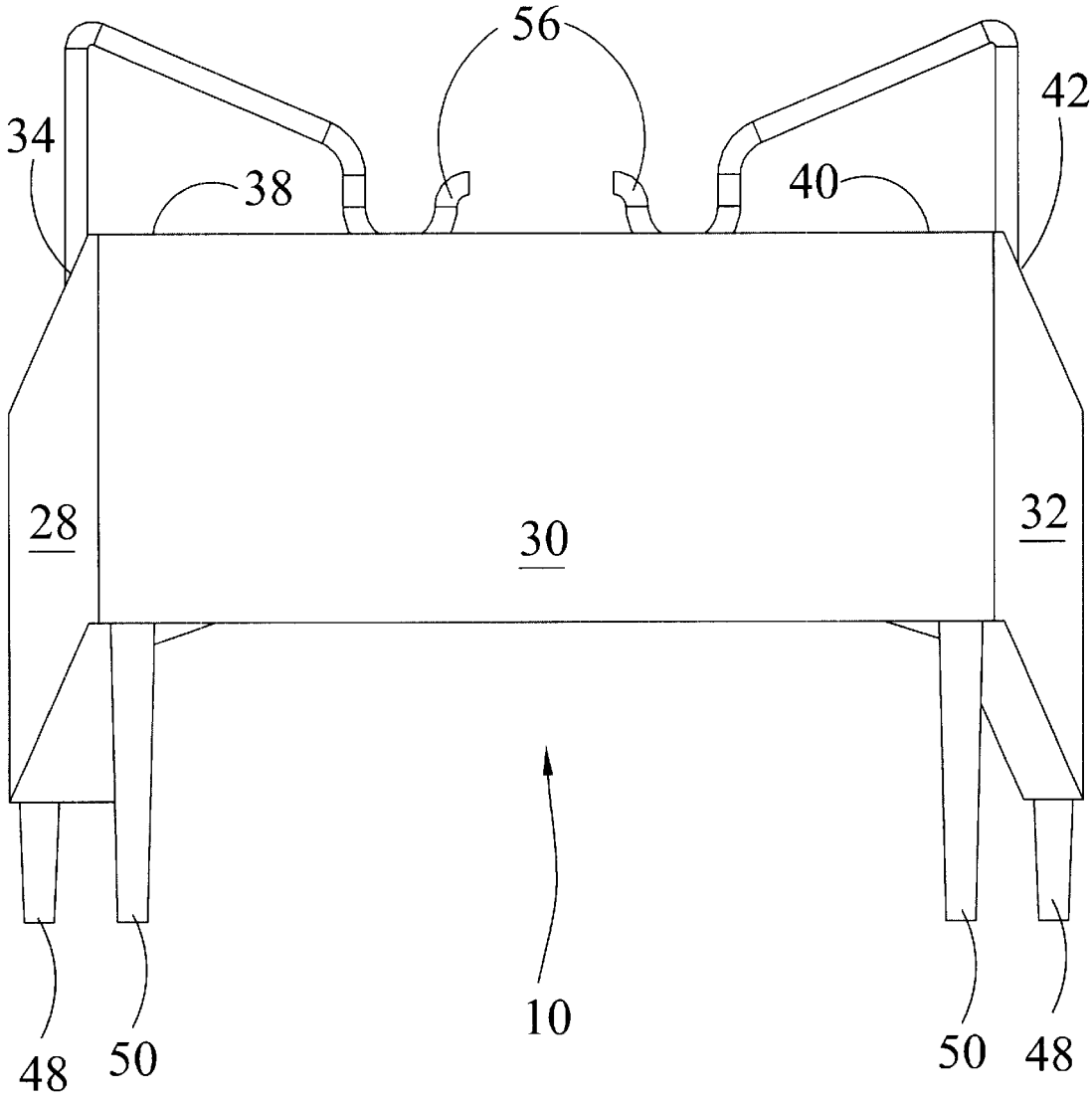
FIG. 8 is a rear elevational view of the improved fireplace insert of the present invention as illustrated in FIG. 2.

Looking now to FIGS. 2 through 4, the fireplace insert 10 includes a substantially convex conduit 22 that is able to substantially surround the andiron 18 on approximately three sides. The conduit 22 includes an inhaling end 24 and an exhaling end 26. In addition, the conduit 22 is preferably divided into three sections: an intake channel 28, a base channel 30, and an outtake channel 32. Moreover, the intake channel 28 includes a proximal end 34 and a distal end 36; the base channel 30 includes a first end 38 and a second end 40; and the outtake channel 32 includes a proximal end 42 and a distal end 44. In the preferred embodiment, the proximal end 34 of the intake channel 28 is connected to the first end 38 of the base channel 30 such that the intake channel 28 is offset, and possibly even substantially perpendicular, to the base channel 30. Likewise, the proximal end 42 of the outtake channel 32 is connected to the second end 40 of the base channel 30 such that the outtake channel 32 is offset with respect to the base channel 30 at an angle similar to the intake channel 28, such that the outtake channel 32 may also be perpendicular to the base channel 30. As a result, the conduit 22 has a substantially convex shape, or a significantly U-shape.

Figure 9:
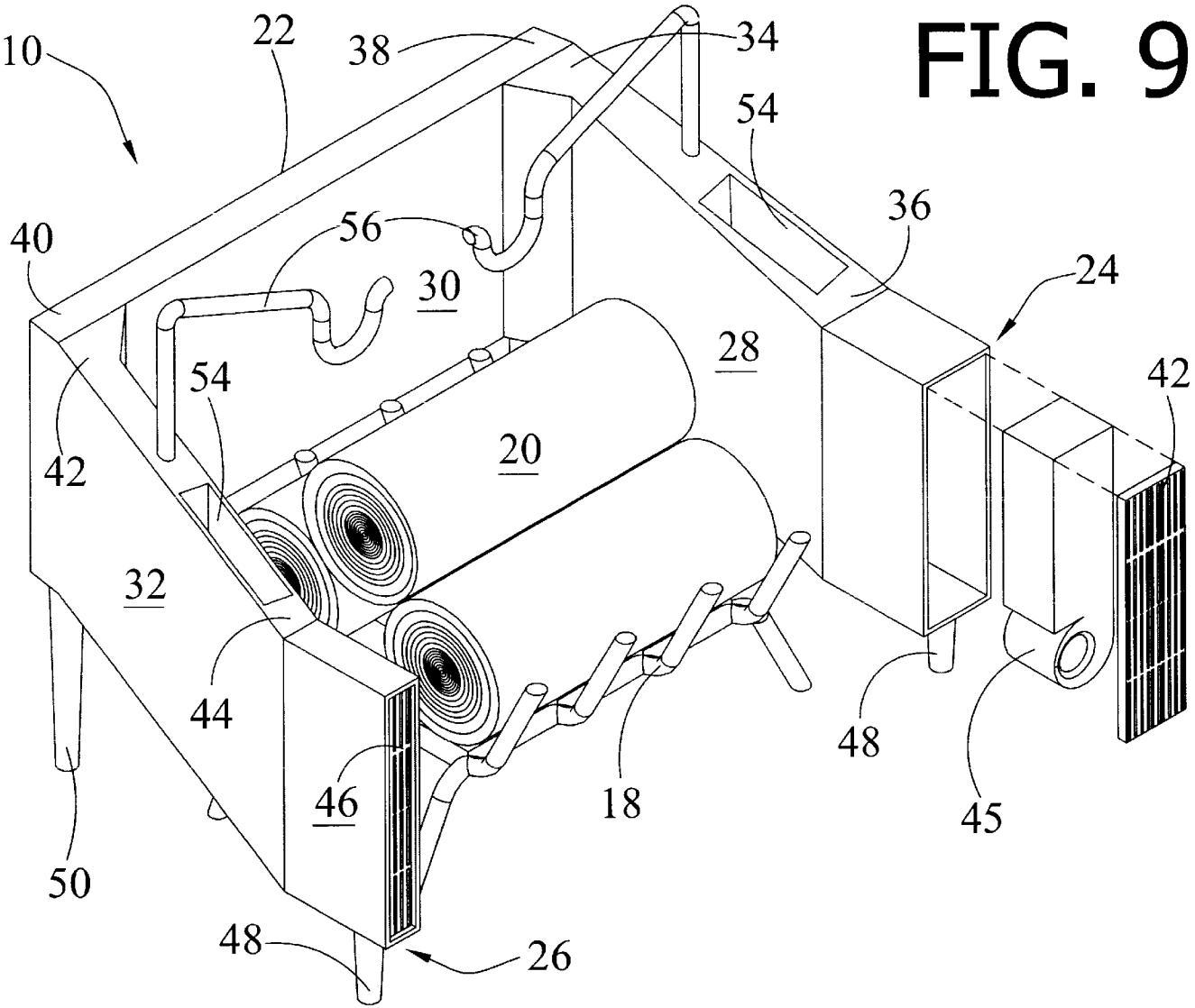
FIG. 9 is a partially exploded view of the improved fireplace insert of the present invention as illustrated in FIG. 2.

Looking now to FIG. 9, the fireplace insert 10 further includes an intake air filter 42 that is mounted to the inhaling end 24 of the conduit 22 and an outtake air filter 46 that is attached to the exhaling end 26 of the conduit 22. Moreover, a fan 44 is mounted or positioned inside the conduit 22 proximate the intake air filter 42. The fan 44 is operable to draw air into the inhaling end 24 of the conduit 22 through the intake air filter 42 in the direction as indicated in FIG. 3. Furthermore, the fan 44 will propel the air through the conduit 22 and out through the outtake air filter 46 into the area that is surrounding the fireplace insert 10. The outtake air filter 46 will thereby prevent undesired debris from passing through the conduit 22. The fan 44 is a conventional blower fan that has a power source that is known in the art, such as a conventional battery or an electric motor. In the preferred embodiment, the speed of the fan 44 and the force of the wind produced by the fan 44 is variable according to the desire of the operator.

Referring now to FIGS. 4 through 8, the fireplace insert 10 includes a series of front legs 48 that are connected proximate the inhaling end 24 and the exhaling end 26 of the conduit 22, and a series of rear legs 50 that are preferably connected to the base channel 30 of the conduit 22. The front legs 48 and the rear legs 50 are used to support the conduit 22 such that conduit 22 is positioned near the heat source or fuel 20 so that the conduit 22 will be warmed. In the favored embodiment, the length of the front legs 48 is shorter than the length of the rear legs 50 so that, when the fireplace insert 10 is positioned on a ground surface, the intake channel 28 and the outtake channel 32 will each have a gradual incline.

Referring back to FIG. 1 for description of the method of operation of the present invention, the fireplace insert 10 is positioned inside the opening 14 of the conventional hearth 12. The andiron 18 and fuel 20 are placed proximate the base channel 30 of the conduit 22 between the intake channel 28 and the outtake channel 32. The fan 44 is then activated such that air is drawn into the intake channel 28 and circulated through the conduit 22 to be expelled through the outtake channel 32. The fuel 20 is then combusted so as to generate a high temperature. In the preferred embodiment, the fuel 20 is conventional firewood, although any other form of combusted fuel 20, such as coal or gas, or any other heat source, could be incorporated into the present design to create the desired high temperature. Because of the position of the fireplace insert 10, the hearth 12 will be protected from the heat source. In particular, the rear portion and sides of the hearth 12 will be protected from damage caused by the flames of the heat source.

The combusted fuel 20 will then act as the heat source for the surrounding area. The heat generated will be transmitted to the conduit 22, such that both the conduit 22 and the surrounded air will be warmed from the heat source. Moreover, the stream of air produced by the fan 44 through the conduit 22 will be heated quickly. Consequently, the air that is expelled by the outtake cylinder 32 will be warmed significantly to be transmitted into the desired surrounding area. Moreover, the stream of heated air will be propelled with a desired thrusting force as determined by the fan 44 to warm a greater surrounding area than a sole combusted fuel in a conventional fireplace.

The conduit 22 may be made of any material that is able to be heated without destruction of the conduit 22. Preferably, the conduit 22 will be made of a metal that is able to be heated quickly by the proximate heat source. Such a material will heat the surrounding air in a more immediate fashion than other conductive substances.

The fireplace insert 10 may additionally include a slot (not illustrated) and that is positioned in the upper surface of both the intake channel 28 and the outtake channel 32, with the slot sized to hold a dish 54. The dish 54 will extend through the slot and into either the intake channel 28 or the outtake channel 32. Consequently, the user will be able to fill the dish 54 with water, which will thereby be heated conductively by the conduit 22 itself and convectively by the air within the conduit 22. The heated water will then provide to steam so that the fireplace insert 10 will further act as a humidifier for the surrounding area.

In a further embodiment of the present invention, a pair of positioning arms 56 are attached to the top surface of the conduit 22 as shown in FIG. 9. The positioning arms 56 are preferably substantially L-shaped, and they are pivotally mounted to the top surface of the conduit 22 to be able to hold a variety of items above the heat source to heat the specific item. For example, a common use of these positioning arms 56 is to hook a pot or other cooking device to the free end. The user is then able to hang the cooking device (not illustrated) on the positioning arm 56 and be supported above the heat source such that the contents of the pot will be heated as desired by the user according to the particular contents.

Thus, although there have been described particular embodiments of the present invention of a new and useful IMPROVED FIREPLACE INSERT, it is not intended that such references be construed as limitations upon the scope of this invention except as set forth in the following claims.

What is claimed is:

1. A fireplace insert for use in a fireplace supporting a heat source, said fireplace insert comprising:

a substantially convex conduit substantially surrounding the heat source, said conduit having a first end and a second end, an upper surface having a cavity positioned proximate said first end of said conduit, a lower surface, parallel connecting walls connecting opposing ends of said upper surface with said lower surface, and a liquid container positioned in said cavity of said upper surface; and a fan positioned in said first end of said conduit to draw air in said first end of said conduit;

wherein said fan propels air through said conduit and out said opening in said second end.

2. The fireplace insert as described in claim 1 wherein said conduit of said fireplace insert further comprises at least two legs connected with said conduit, said legs supporting said conduit in the fireplace.

3. The fireplace insert as described in claim 1 wherein said fan operates at varying speeds.

4. The fireplace insert as described in claim 1 further comprising a intake filter mounted to said first end of said conduit.

5. The fireplace insert as described in claim 1 further comprising an outtake filter mounted to said second end of said conduit.

6. The fireplace insert as described in claim 1 further comprising a support rod pivotally mounted in said conduit; and a cooking instrument attached to said support rod, wherein said support rod is rotatable to vary the position said cooking instrument with respect to the fuel.

7. The fireplace insert as described in claim 1 wherein said conduit is made of heavy gauge metal to transmit heat from the fuel.

8. The fireplace insert as described in claim 1 wherein said conduit comprises:

a rear channel having a first end and a second end;

a intake channel connected to said first end of said rear channel; and a outtake channel having a proximal end and a distal end, said proximal end connected to said second end of said rear channel;

wherein the width of said outtake channel increases from said proximal end to said distal end.

9. The fireplace insert as described in claim 8 wherein said distal end of said intake channel descends from said proximal end of said intake channel; and said distal end of said outtake channel descends from said proximal end of said outtake channel.

10. The fireplace insert as described in claim 1 wherein said conduit is substantially U-shaped.

11. A method for transmitting heat comprising the steps of:

a) providing a heat source;

b) substantially surrounding said heat source with a convex conduit having a first end and a second end, wherein said conduit is hollow;

c) inserting a fan in said first end of said conduit;

d) drawing air into said first end of said conduit;

e) heating said air in said conduit with said heat source; and f) forcing said heated air out of said second end of said conduit.

12. The method as described in claim 11 wherein step b) further comprises the step of substantially surrounding said heat source with a U-shaped conduit.

13. The method as described in claim 11 wherein step e) further comprises positioning said heat source proximate said conduit to convectively heat said conduit.

14. A method for transmitting heat comprising the steps of a) providing a heat source;

b) substantially surrounding said heat source with a convex conduit having a first end and a second end, wherein said conduit is hollow;

c) drawing air into said first end of said conduit;

d) heating said air in said conduit with said heat source; and e) providing an air filter affixed to said second end of said conduit;

f) forcing said heated air out of said second end of said conduit.

* * * * *